US005414484A

United States Patent [19]

Hofmuth et al.

[11] Patent Number: 5,414,484

[45] Date of Patent: May 9, 1995

[54] CASCADE ASSEMBLY FOR USE WITH APPARATUS FOR DEVELOPING A PHOTOGRAPHIC EMULSION CARRIER

[75] Inventors: Walter Hofmuth; Alfons Kastl; Helmut Schausberger; Anton Wimmer, all of München, Germany

[73] Assignee: Agfa-Gevaert Aktiengesellschaft, Leverkusen, Germany

[21] Appl. No.: 178,190

[22] Filed: Jan. 6, 1994

[30] Foreign Application Priority Data

Feb. 18, 1993 [DE] Germany ..... 43 04 907.9

[51] Int. Cl.[6] ..... G03D 3/02; G03D 3/08

[52] U.S. Cl. ..... 354/321; 354/324

[58] Field of Search ..... 354/316–324, 354/331, 336; 134/64 P, 122 P, 122 R; 430/398–400

[56] References Cited

U.S. PATENT DOCUMENTS 4,142,194 2/1979 Hamlin ..... 354/318
4,464,035 8/1984 Schoering ..... 354/322 X
5,059,996 10/1991 Bailey et al. ..... 354/317

FOREIGN PATENT DOCUMENTS 3927368 2/1991 Germany .
15806 10/1991 WIPO .

*Primary Examiner*—D. Rutledge
*Attorney, Agent, or Firm*—Karl F. Milde, Jr.

[57] ABSTRACT

Apparatus for developing a photographic emulsion carrier. The carrier travels through a succession of tanks of photographic processing fluid. The apparatus includes mechanisms that forward the carrier through the tanks, a drive device that operates the forwarding mechanisms, guides that guide the carrier from one tank into the next, and means that connect an inlet for each processing fluid with its associated tank. The apparatus also includes at least one separate assembly associated with at least one tank, for forming a cascade which includes means for conveying the processing fluid from at least one cascade stage to the tank. The assembly, for forming the cascade is a separate module that rests as a cover on the tanks and has a separate inlet for receiving processing fluid. The cascade assembly accommodates a mechanism that forwards the carrier through it. This mechanism couples with the mechanisms that forward the carrier through the tanks while the cascade assembly is resting on them.

9 Claims, 3 Drawing Sheets

CASCADE ASSEMBLY FOR USE WITH APPARATUS FOR DEVELOPING A PHOTOGRAPHIC EMULSION CARRIER

BACKGROUND OF THE INVENTION

The present invention concerns apparatus for developing a photographic emulsion carrier. In this apparatus, the carrier travels through a succession of tanks of processing fluid. The apparatus includes mechanisms that forward the carrier through the tanks, a drive device that operates the carrier-forwarding mechanisms, guides that guide the carrier from one tank into the next, and means that connect an inlet for each processing fluid with its associated tank. The apparatus also includes at least one device, associated with at least one tank, for cascading processing fluid against the carrier.

Emulsion-coated carriers are conventionally developed by forwarding them through a series of tanks of different processing fluids (chemicals or water). The used fluids are discarded. It has been demonstrated that cascading the fluids in each tank, conveying them upstream against the advancing carrier, reduces the amount of discarded fluids as well as the level of contaminants therein. It is, however, impossible for every tank to have its own cascade assembly because the overall apparatus would be too large.

The German published patent application No. OS 3,927,368 discloses spraying a regenerating fluid for several of the processing fluids over the emulsion-coated carrier as it leaves the bath. The carrier is accordingly treated at that point with fresh fluid, which then flows down into the tank and regenerates the fluid therein.

An apparatus is known from the published international application No. WO 91/15806 in which the emulsion-coated carrier travels through small accessory tanks, arranged above the main-tanks, that operate like cascade stages.

Environmental protection regulations, especially those relating to the level of contaminants in the effluent, differ from country to country. There is accordingly a significant need for a photographic processing apparatus that can satisfy different national regulations without having to be completely modified for each country.

SUMMARY OF THE INVENTION

A principal object of the present invention is accordingly to provide a cascade assembly that can be retrofit onto apparatus for developing a photographic emulsion carrier.

A further object of the invention is to provide apparatus for developing a photographic emulsion carrier that can be operated with or without additional cascade stages and can even have the cascade stages added later.

These objects, as well as other objects which will become apparent from the discussion that follows, are achieved, in accordance with the invention, by providing an assembly for forming the cascade which is a separate module adapted to rest as a cover on the tanks of a developing apparatus, and by providing means that connect the processing fluid supply of a developing apparatus to the cascade assembly. The cascade assembly accommodates a mechanism that conveys the carrier through it and that couples with the mechanisms which forward the carrier through the processing fluid tanks while the cascade assembly is resting on them.

Such a cascade assembly can easily and inexpensively be adapted to comply with different regulations. It can be retrofit on developing apparatus that has been operating without cascades and accordingly does not comply with new regulations by equipping it with cascade stages, a very simple procedure. It will also remain possible to ship developing apparatus without cascades to areas where the environmental regulations are not as strict. In the latter event the processing fluids will enter the tanks directly, while the apparatus operators will still have the option of purchasing and installing the cascades when their local regulations so require.

To reduce the level of contaminants in the effluent, each cascade assembly will preferably be in two stages. Processing is particularly effective when the processing fluid associated with each stage is cascaded onto both the emulsion side and the back of the carrier by means of spray heads. Preferably, the spray heads of each stage are arranged between two pairs of rollers, one upstream and the other downstream. The downstream pair squeezes the fluid associated with that cascade stage off the carrier as it leaves the stage and returns it to an intermediate reservoir. A pump conveys the fluid back to the spray heads associated with that stage. Unused fluid is forwarded to the cascade stage that the carrier has just traveled through. To this end, the fluid is passed through an overflow from the intermediate reservoir to the next upstream cascade stage. The fluid returns to the actual processing tank by way of an overflow in the most upstream cascade stage.

The cascade assembly in one preferred embodiment of the invention cascades fixer and is mounted above the partition between the fixer tank and the water tank of the developing apparatus.

For a full understanding of the present invention, reference should now be made to the following detailed description of the preferred embodiment of the invention as illustrated in the accompanying drawings.

DESCRIPTION OF THE PREFERRED EMBODIMENT

Figure 1:
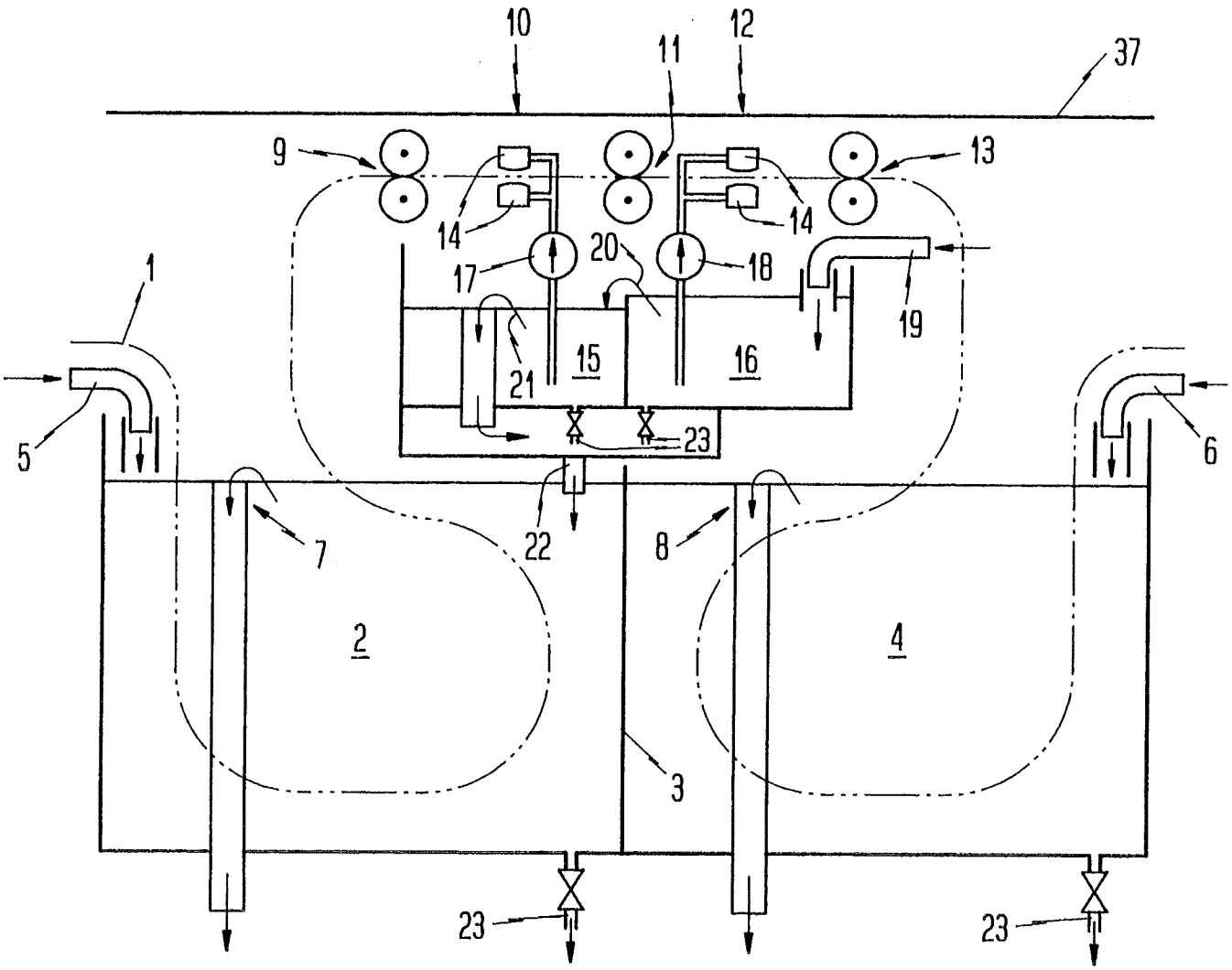
FIG. 1 is a schematic representation of a two-stage cascade assembly mounted above the partition between the fixer tank and the water tank of a photographic developing apparatus.

The preferred embodiment of the present invention will now be described with reference to FIGS. 1–3. Identical elements in the various figures are designated with the same reference numerals.

The dot-and-dash line in FIG. 1 represents a carrier 1 coated with photographic emulsion and traveling through a developing apparatus. Carrier 1 is forwarded from an unillustrated tank of developer and an unillustrated tank of intermediate rinse water into a tank 2 of fixer. This fixer, tank 2 is separated by a partition 3 from a rinse water tank 4. The fixer tank 2 has an inlet 5 for fresh fixer and an overflow pipe 7 for used fixer. The rinse water tank 4 has an inlet 6 for fresh water and an overflow pipe 8 for contaminated water.

A two-stage cascade assembly is mounted above the partition 3 between the fixer tank 2 and the rinse water tank 4 for treating the carrier with fixer fluid. Carrier 1 travels through a pair 9 of forwarding rollers into the upstream stage 10 of the cascade assembly. The carrier next travels through another pair 11 of forwarding rollers, the downstream stage 12 of the cascade assembly, and a third pair 13 of forwarding rollers. At this point the carrier leaves the cascade assembly and enters the rinse water tank 4.

Both sides of the carrier are sprayed with fixer from spray heads 14. This processing fluid is squeezed off the carrier as it leaves upstream cascade stage 10 by the second pair 11 of forwarding rollers and as it leaves downstream cascade stage 12 by the third pair 13 of forwarding rollers. The excess fluid drops into intermediate reservoirs 15 and 16. Spray heads 14 are supplied with fixer from the tanks 15 and 16 by pumps 17 and 18, respectively.

When the developing apparatus is operated with the cascade assembly in place, an unillustrated hose that supplies fresh fixer is simply transferred from the fixer tank inlet 5 to the inlet 19 of the downstream cascade stage 12. Inlet 19 then supplies fresh fixer to the intermediate reservoir 16. The fixer flows out of the intermediate reservoir 16 and into the collecting tank 15 in upstream cascade stage 10 via a spillover edge 20. The fixer finally enters the fixer tank 2 by way of an overflow pipe 21 and a drain 22. Intermediate reservoirs 15 and 16 and tanks 2 and 4 can be emptied through drains 23, which are generally closed.

Figure 2:
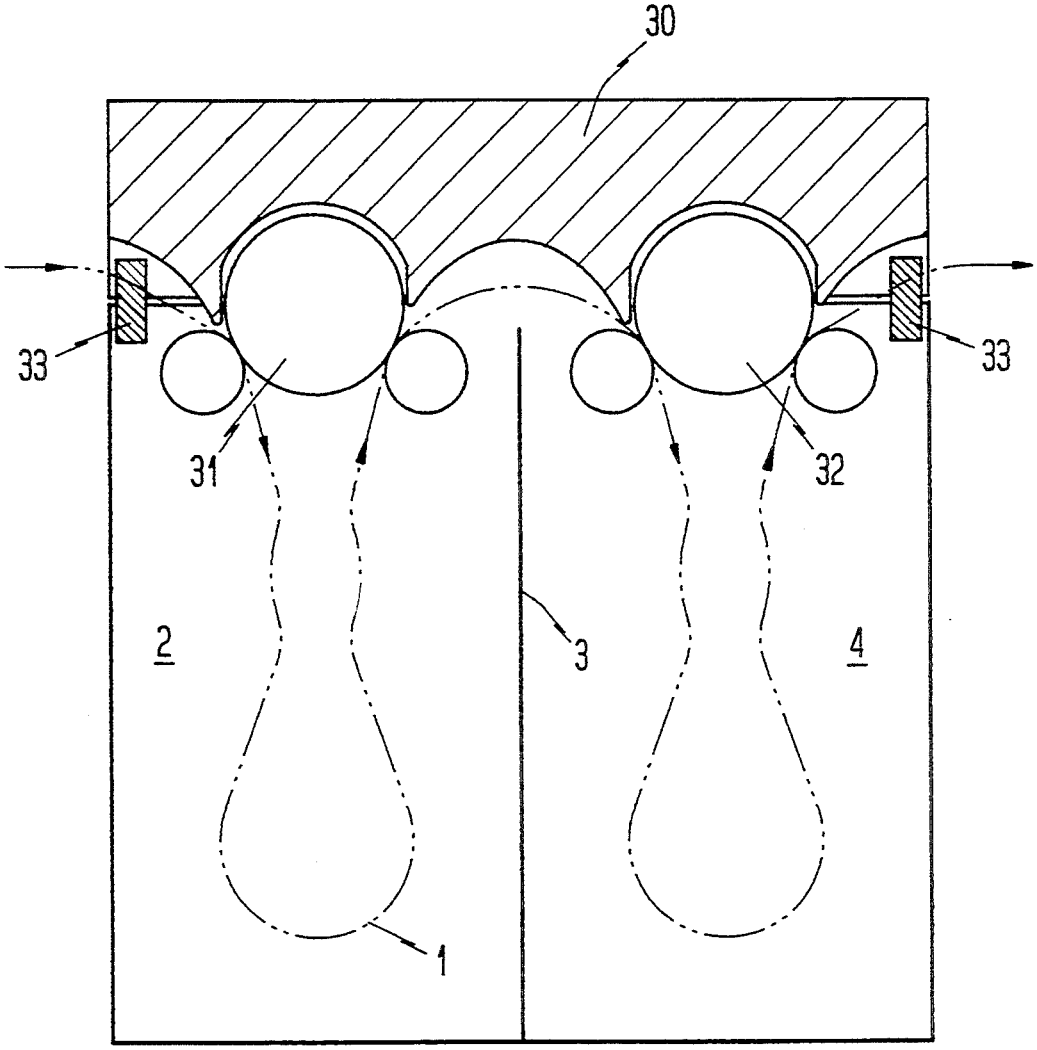
FIG. 2 illustrates the fixer tank and water tank of a photographic developing apparatus with a mechanism for forwarding an emulsion-coated carrier therethrough.
Figure 3:
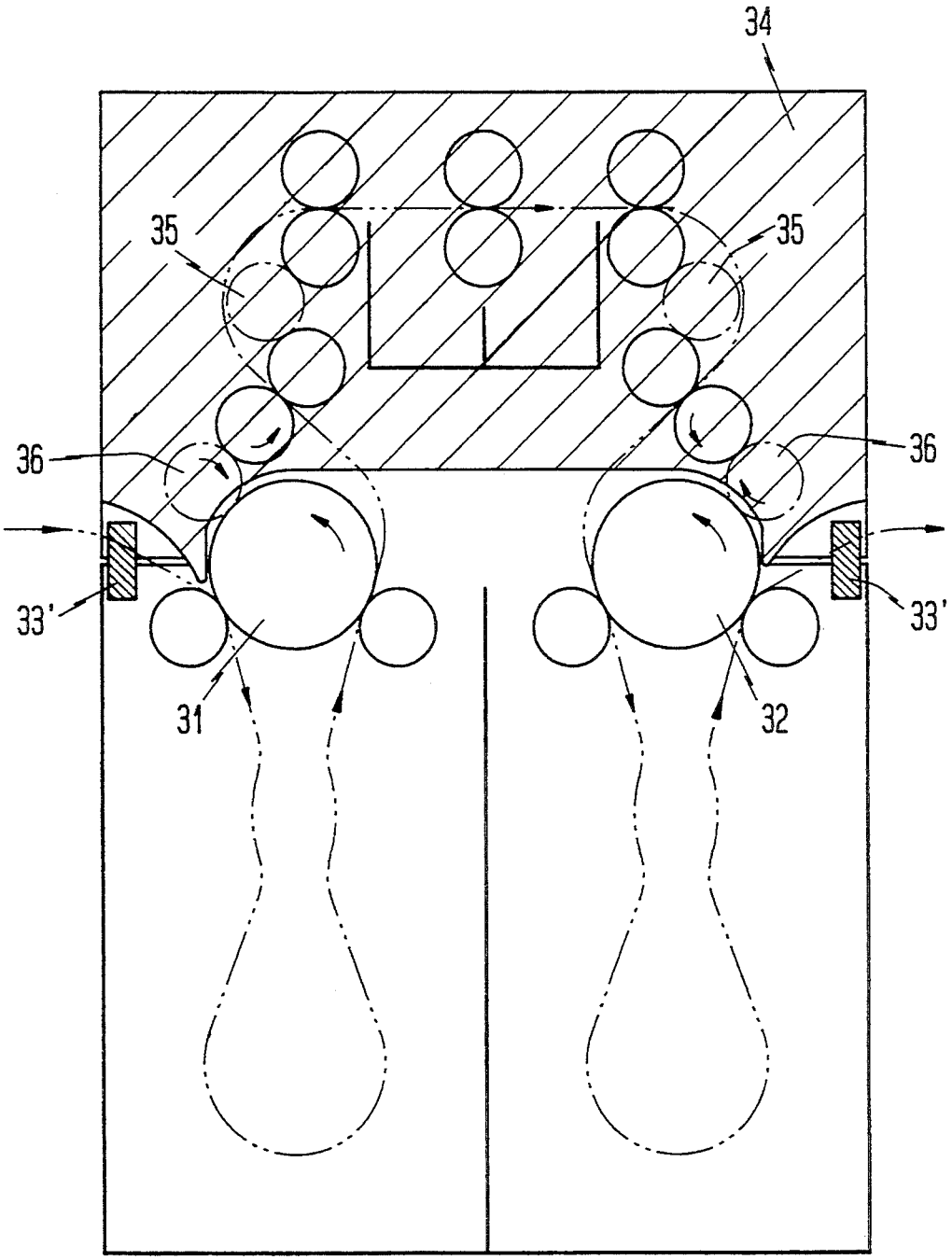
FIG. 3 illustrates the tanks shown in FIG. 2 but with a two-stage cascade assembly mounted above them instead of the forwarding mechanism.

The modular structure of the cascade assembly will be particularly evident from FIGS. 2 and 3. Referring to FIG. 2, the carrier 1 is forwarded from an intermediate rinse water tank (not shown) to the fixer tank 2 by way of a guide 30 and a powered roller 31. The mechanisms that forward and guide the carrier inside the tanks 2 and 4 are unillustrated for simplicity's sake. The carrier 1 leaving fixer tank 2 returns to the guide 30 and is forwarded into the rinse water tank 4 by another powered roller 32. From the rinse water tank the carrier returns to guide 30, which guides it into an unillustrated dryer. Guide 30 is secured with bolts 33 that fit into the open tops of the tanks.

As illustrated in FIG. 3, the developing apparatus of FIG. 2 can be refitted simply by replacing the guide 30 with a cascade assembly 34. The assembly 34 is secured with similar bolts 33'. All the mechanisms in the cascade assembly 34 are mechanically coupled to the mechanisms in the main apparatus so that no separate motor is required. In particular, the cascade drive mechanism is coupled to the main drive mechanism by gears 35 and 36, represented by broken lines. Gears 36 directly engage gears that drive the rollers 31 and 32. The mechanisms that drive the pumps 17 and 18 can similarly be coupled to the drive mechanisms in the main apparatus. Since, however, the cascade assembly 34 will require some electrical power of its own, for monitoring the liquid level and temperature for example, the pumps can alternatively be electrically connected to the power source of the developing apparatus. This may be accomplished by connecting an electrical cord leading from the cascade assembly to an outlet in the main apparatus.

If processing is to occur in an illuminated environment, the overall apparatus can be accommodated within a hood 37 illustrated in FIG. 1. The hood 37 will completely prevent outside light from reaching carrier 1 at any point within the apparatus.

Such a cascade assembly can of course be employed in conjunction with other stages of photographic processing when desired. The assembly can also have one, two, or more stages.

There has thus been shown and described a novel cascade assembly for use with photographic developing apparatus that fulfills all the objects and advantages sought therefor. Many changes, modifications, variations and other uses and applications of the subject invention will, however, become apparent to those skilled in the art after considering this specification and the accompanying drawings which disclose the preferred embodiment thereof. All such changes, modifications, variations and other uses and applications which do not depart from the spirit and scope of the invention are deemed to be covered by the invention, which is to be limited only by the claims which follow.

What is claimed is:

1. A cascade assembly for use with apparatus for developing a photographic emulsion carrier, said apparatus comprising at least one inlet for photographic processing fluid; a plurality of tanks for photographic processing fluid and means for forwarding the carrier through said processing fluid in said tanks, in succession; said cascade assembly comprising, in combination:

(a) at least one cascade forming stage for bringing said carrier in contact with said processing fluid and means for conveying said processing fluid from said cascade stage into a processing fluid tank of said developing apparatus;

(b) means for conveying said carrier through the cascade assembly; and (c) means, coupled to said at least one cascade stage and adapted to be connected to said fluid inlet, for supplying processing fluid to said at least one cascade stage;

wherein said cascade assembly is adapted to be placed, as a cover, over said tanks, and wherein said carrier conveying means is adapted to be coupled mechanically to said carrier forwarding means while the cascade assembly is resting on said tanks.

2. The cascade assembly defined in claim 1, wherein the assembly has two cascade stages.

3. The cascade assembly defined in claim 1, wherein said at least one cascade stage includes an upstream and a downstream pair of carrier-forward rollers and includes at least one spray head arranged between said pairs of forwarding rollers that sprays both the front and back of the carrier with processing fluid.

4. The cascade assembly defined in claim 3, wherein said at least one cascade stage includes an intermediate fluid reservoir.

5. The cascade assembly defined in claim 4, wherein said at least one cascade stage includes a pump that supplies the associated spray head with fluid from the associated intermediate fluid reservoir.

6. The cascade assembly defined in claim 5, wherein said at least one cascade stage includes an overflow from the associated intermediate fluid reservoir.

7. The cascade assembly defined in claim 6, wherein the overflow in said at least one cascade stage conveys fluid into a processing fluid tank of said developing apparatus.

8. The cascade assembly defined in claim 1, comprising a plurality of cascade stages and wherein said processing fluid supplying means include means for supplying processing fluid to a first cascade stage of the cascade assembly.

9. The cascade assembly defined in claim 1, wherein said processing fluid tanks of said developing apparatus include a fixer tank and a rinse water tank separated by a partition; wherein the cascade assembly is adapted to be mounted above said partition and wherein said processing fluid supplying means supplies said at least one cascade stage with fixer fluid.

* * * * *